US009672709B2

(12) United States Patent
Moradian et al.

(10) Patent No.: US 9,672,709 B2
(45) **Date of Patent: *Jun. 6, 2017**

(54) DEVICE AND ITS USE FOR DETERRING WEARING AND RETURNING OF MERCHANDISE

(71) Applicants: Payam Moradian, Los Angeles, CA (US); Amos Tabibian, Woodland Hills, CA (US)

(72) Inventors: Payam Moradian, Los Angeles, CA (US); Amos Tabibian, Woodland Hills, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/968,699

(22) Filed: Dec. 14, 2015

(65) Prior Publication Data

US 2016/0098908 A1 Apr. 7, 2016

Related U.S. Application Data

(63) Continuation of application No. 14/180,783, filed on Feb. 14, 2014, now Pat. No. 9,214,075, which is a continuation of application No. 13/274,356, filed on Oct. 17, 2011, now Pat. No. 8,653,973.

(60) Provisional application No. 61/394,316, filed on Oct. 18, 2010.

(51) Int. Cl.
*G08B 13/14* (2006.01)
*G08B 13/24* (2006.01)

(52) U.S. Cl.
CPC ..... *G08B 13/2451* (2013.01); *G08B 13/2434* (2013.01)

(58) Field of Classification Search
CPC .... G08B 13/12; G08B 13/14; G08B 13/2434; G08B 13/2451
USPC ..... 340/568.1, 568.4, 572.1–572.8; 235/383, 235/385, 492
See application file for complete search history.

(56) References Cited

U.S. PATENT DOCUMENTS

| | | | | |
|---|---|---|---|---|
| 4,240,183 | A * | 12/1980 | Sumimoto | F16B 21/088 24/16 PB |
| 4,750,284 | A * | 6/1988 | Parry | A01K 11/001 119/655 |
| 5,151,684 | A | 9/1992 | Johnsen | |
| 5,428,875 | A | 7/1995 | Nguyen | |
| 5,799,375 | A * | 9/1998 | Fukami | B65C 7/001 140/93 A |
| 5,945,909 | A | 8/1999 | Kolton | |
| 6,226,911 | B1 | 5/2001 | Wescombe | |
| 6,247,591 | B1 | 6/2001 | Grendol | |
| 6,735,895 | B2 | 5/2004 | Wada | |
| 7,456,741 | B2 | 11/2008 | Norman | |
| 7,461,613 | B2 | 12/2008 | Sinclair | |
| 7,868,769 | B2 | 1/2011 | March | |
| 2008/0048030 | A1 | 2/2008 | Garner | |
| 2010/0225485 | A1 | 9/2010 | Appalucci | |

OTHER PUBLICATIONS

Bloomingdale's new b-tags block used clothing returns—Today.com, Dec. 17, 2013.

(Continued)

*Primary Examiner* — Tai T Nguyen

(57) ABSTRACT

Provided is a device for deterring purchase-wear-return of merchandise, particularly women's dresses, by a consumer.

21 Claims, 6 Drawing Sheets

(56) References Cited

OTHER PUBLICATIONS

Bloomingdale's Black Tags End Party for NextDay Returns, Dec. 17, 2013.
Sincerity Tags at Bloomingdales, May 30, 2014.
Antishoplifting Tag, accessed Feb. 22, 2017.
EAS Tags—A Brief History, Jun. 16, 2015.
American Theft Invention Products, Inc., accessed accessed Feb. 22, 2017.
Shark tag, accessed Feb. 22, 2017.
Google Image Result for http_____americantheftprevention.com__images__products__1995, accessed Feb. 22, 2017.

* cited by examiner

FIG. 16
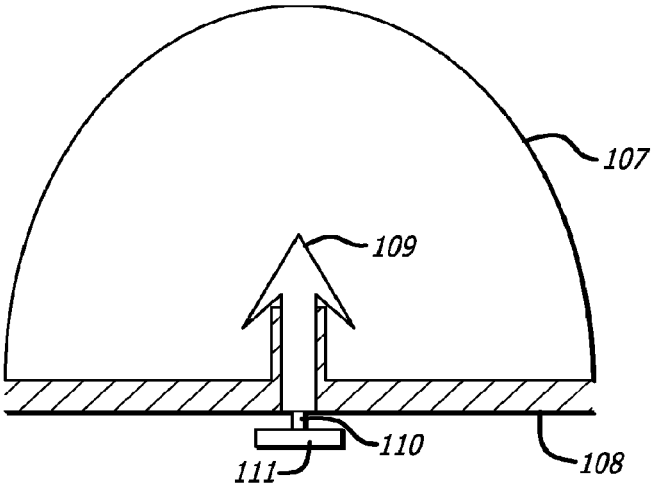
FIG. 17
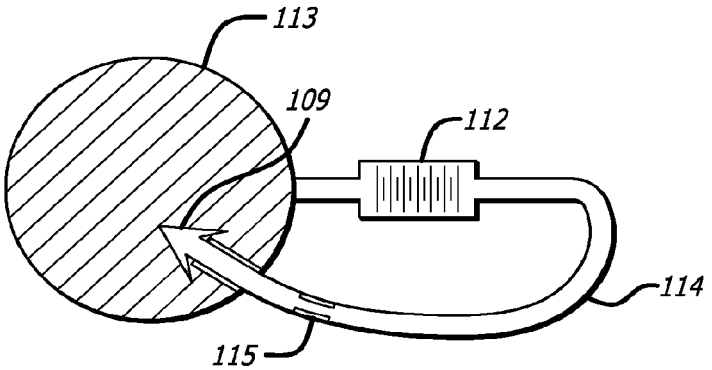
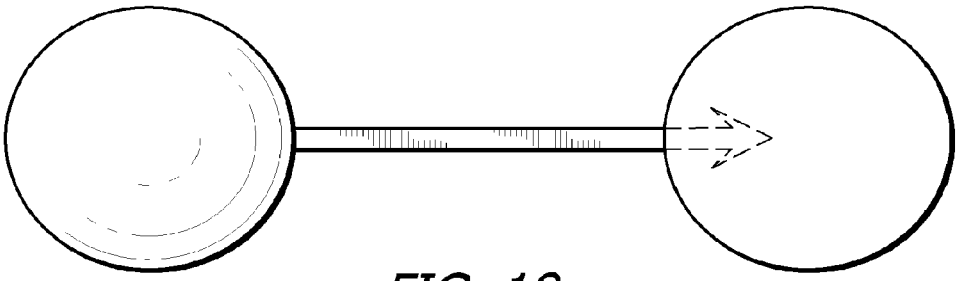
FIG. 18

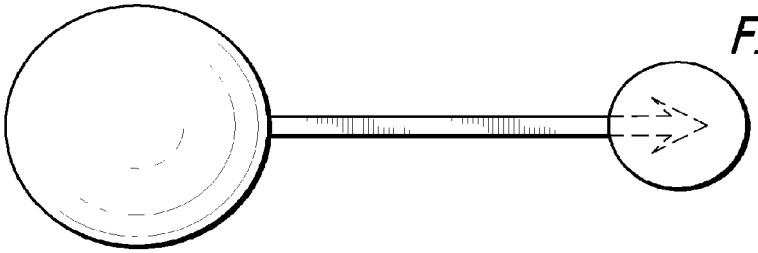
FIG. 19
FIG. 20
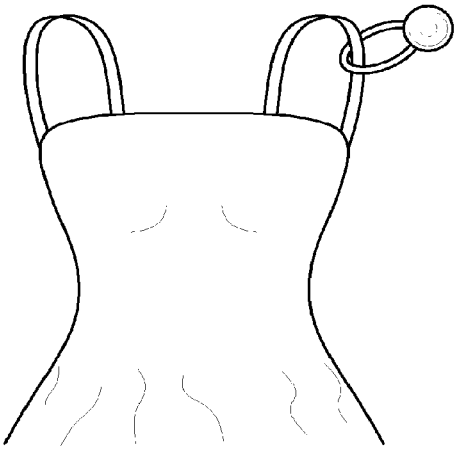
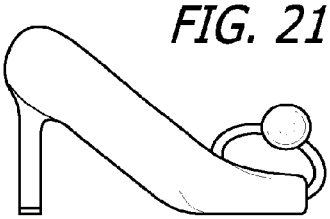
FIG. 21
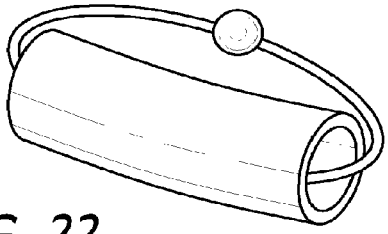
FIG. 22
FIG. 23
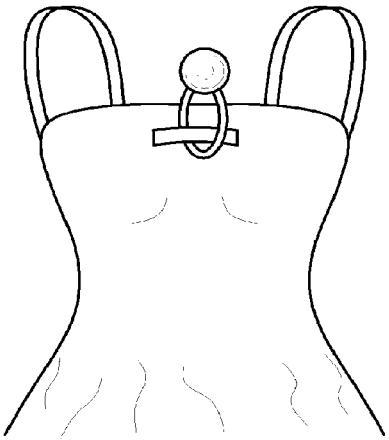

DEVICE AND ITS USE FOR DETERRING WEARING AND RETURNING OF MERCHANDISE

CROSS-REFERENCE

This application is a continuation of Ser. No. 14/180,783 filed on Feb. 14, 2014, which is a continuation of Ser. No. 13/274,356 filed on Oct. 17, 2011, which claims the benefit of U.S. Provisional Appl. No. 61/394,316 filed on Oct. 18, 2010, all of which are incorporated by reference herein in their entirety.

BACKGROUND SECTION OF THE INVENTION

A particular group of consumers take the unethical approach of purchasing a merchandise, particularly an article of clothing, wearing it on a certain occasion, and then returning it for a refund. This purchase, wear and return phenomenon is common for expensive pieces of clothing, particularly women's dresses. Some consumers go as far as having the article of clothing dry cleaned before returning it so that no evidence exists that the article of clothing was worn on an occasion.

This purchase-wear-return scheme causes economic damage to retailers, manufacturers and ultimate bona-fide buyers. The article of clothing can be damaged and it may no longer have the same feeling of a new article of clothing. The efforts of the sales staff is wasted for a purchase that at end of the day would not make a profit. A sale would also be lost because the purchaser who returns an article of clothing does not ultimately purchase such article of clothing.

The current anti-theft devices do not deter consumers from carrying out this scheme. The anti-theft devices on the market are designed to be used in a store to stop shoplifters. They require a special tool that only a retailer has and are not designed to be taken outside of the store by a purchaser.

There is a need in the art for a device to deter consumers from buying, wearing, and then returning an article of clothing.

SUMMARY OF THE INVENTION

In one embodiment, provided is a device comprising a conspicuous part, wherein the device is attached to a merchandise that a consumer purchases and the consumer after removing the device cannot put back the device on the merchandise, wherein the device is so conspicuous that it would bring embarrassment to the consumer if the consumer wears the merchandise with the device attached and a seller would not take back the merchandise without the device attached thereto. The device can have mechanical components without electrical components. The device can have both mechanical and electrical components. The consumer can be made aware that once the device is removed, the article of clothing cannot be returned. The device can have at least one cross-section that is about 1 centimeter or bigger, at least about 2 or more centimeters or at least about 3 or more centimeters. The color and/or shape of the device can be selected based on the merchandise to make it conspicuous. The device can have an LED or other light with a constant or flashing mode. The device can be fluorescent. The device can be attached to a lower seam of a short. dress. The device can have a timer that is activated when the device is removed by the consumer, giving the consumer time to try the merchandise without the device before putting the device in its original condition. The device may not interfere with wearing the merchandise in private to determine whether or not to keep the item of merchandise. The device can have a unique identification code (serial number), or a barcode. The consumer can be encouraged to return the device by giving a deposit back for the device. The consumer can be given a pre-paid envelope to return the device. An anti-theft device can be incorporated into the device. The merchandise can be women's dresses, men's suits, shoes. Handbags, jackets, coats, pants, jewelry, and rings. The device can encompass a pin and a receiver, wherein the pin goes through the merchandise and into the receiver, wherein the pin cannot be removed from the receiver without breaking the pin or the receiver. The pin can be a barbed pin. The pin can have ridges that are held in place by a latch in the receiver. A rectangular profile pin can be inserted into a receiver. The receiver can have a plastic molded shell. The device can contain a latch made of a metal that conducts electricity. The latch can be bent away from the point of insertion of a pin. An electric circuit can be formed after a pin is inserted. The pin can have built in weak area at its base. The circuit can turn on an LED that remains on until device is returned to the retailer or removed and discarded. The device can further comprise electronics that will allow one to do the following: a) strobe the light to increase its effectiveness by making it more noticeable; b) strobe the light once every 5-60 seconds to preserve the battery life and still keep the product effective; c) add a timer that will keep the LED lit for a set period of time before turning it off. The device can further include a timer that will keep the LED lit for a set period of time before turning it off in conjunction with a stores return policy. The device can go on two different parts of the merchandise. The device can be attached to shirt or coat sleeves or pant legs and attached via a cable. The device can be attached to multiple parts of a dress. An electrical circuitry can allow the cable to be disconnected for a set amount of time, 0.5 hour for example, before it goes into alarm mode. An alarm mode can be detected by the retailer by monitoring a light emitting diode (LED). Both parts of this device can be set to send and receive a unique code. The device can be designed to loop around a part of the merchandise without going through the merchandise. The device can comprise at least one bulky object that cannot go through a part of the merchandise and a strap that goes into a receiver so that the device cannot be removed, the strap going into the same bulky object or another bulky object. The device can use a bulky object that is made of entirely plastic, or a combination of plastic and foam. The device can use a ball as a bulky object. The strap can be inserted into the receiver by a salesperson. The device can have a strap that has a mating end with one or more ridges. The latch present in the receiver where the ridges of the mating end "click" into and the strap can no longer be taken out the receiver, leaving the consumer with the choice of cutting the strap to remove the device. The device can include a latch that allows for entry of the mating end but not its exit. The strap's head can compress through the channel of the receiver but cannot come out. The device can have at least one bulky object with a diameter of about 2 to about 5 inches. The strap and the bulky object can be of the same piece of plastic. Two bulky objects of different shapes and sizes, or identical objects, can be used. A pin may not be used. The device can loop around a strap. The strap can be that of a dress or a handbag. The device can loop around front of opened end shoe. The device can loop around a tag. The device can loop around a sleeve.

In another embodiment, provided is a piece of merchandise comprising the merchandise and a device as provided above.

In another embodiment, provided is a method of deterring a customer from purchasing, wearing and returning a piece of merchandise comprising attaching the device of any of the previous embodiments to the merchandise for the customer to take the merchandise that is attached thereto the device. A seller can first check in a database to determine whether a customer has returned merchandise before, and if the answer is yes, then the seller attaches the device. A seller can first check information in a database about a customer, such as a credit score, and if the customer does not satisfy the minimum requirements set by the seller, then the seller attaches the device.

In another embodiment, provided is a device for deterring purchase-use-return of merchandise to be worn on the body by a consumer comprising one or more parts that allow for attachment of the device to the merchandise in such manner that a consumer can readily remove the device after purchasing the merchandise, wherein after removing the device the consumer cannot put back the device on the merchandise in the original condition, wherein the device is so conspicuous after attachment that the consumer cannot wear the merchandise without removing the device, and wherein a seller of the merchandise would not take back the merchandise without the device attached thereto.

BRIEF DESCRIPTION OF THE FIGURES

FIG. 16 is a mechanical design with a pin and a receiver.

FIG. 17 shows a pin-free design for looping around a part or all of the merchandise.

FIG. 18 shows a pin-free design for looping around a part or all of the merchandise.

FIG. 19 shows a pin-free design for looping around a part or all of the merchandise.

FIG. 20 shows the pin-fee device lopping around a strap of a dress.

FIG. 21 shows the pin-fee device lopping around front of a show.

FIG. 22 shows the pin-fee device lopping around a sleeve.

FIG. 23 shows the pin-fee device lopping around a tag.

DETAILED DESCRIPTION OF THE INVENTION

Figure 1:
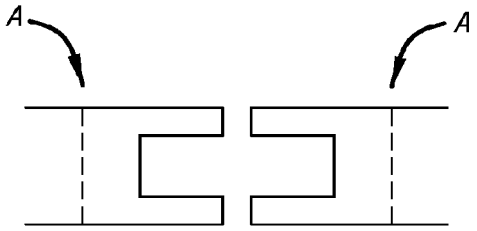
FIG. 1 shows the opening in the receiver for the pin to be inserted.
Figure 2:
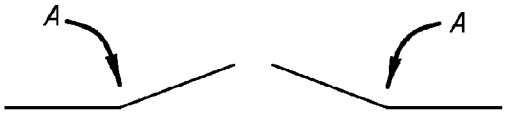
FIG. 2 shows the latch present in the receiver where the latch is indented in the direction that the pin inserted.
Figure 3:
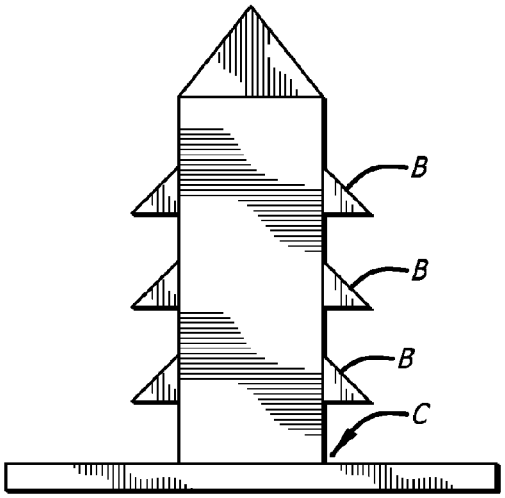
FIG. 3 shows a barbed pin that is inserted in the receiver (front view).
Figure 4:
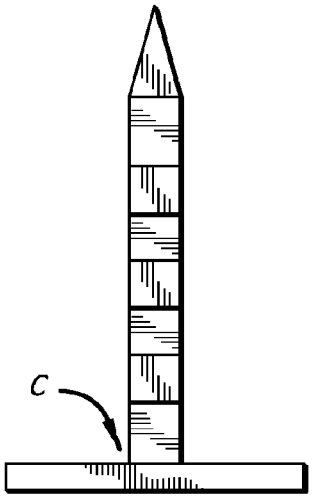
FIG. 4 shows a barbed pin for insertion in the receiver (side view).
Figure 5:
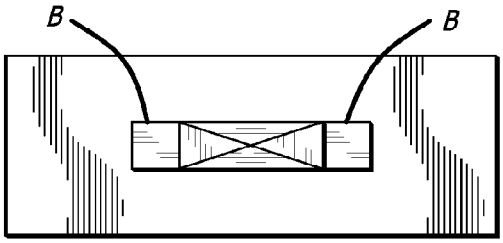
FIG. 5 shows a barbed pin that is insertion in the receiver (top view).

The present invention provides a device to be used on an article of clothing so that a consumer cannot purchase, wear and then return an article of clothing. The device is sufficiently conspicuous so that the consumer has to remove it before wearing it on an occasion; otherwise the conspicuous nature of the device would bring embarrassment to the consumer. The device cannot be reassembled by the consumer.

The device is attached to the article of clothing prior to the consumer taking the article of clothing home. The consumer can be made aware that once the device is removed, the article of clothing cannot be returned. The consumer can remove the device easily without a special tool. After removal of the device, the device cannot be put back in its original condition. For example, the device, can have two parts, and after removal, the two parts cannot be put together again. The device can rely on electrical mechanical components, or a combination thereof, to achieve this purpose.

The device is sufficiently conspicuous so that it would be easily noticed at an occasion like a wedding or a prom. In one embodiment, the device has at least one cross-section that is about 1 centimeter or bigger, more preferable at least about 2 or more centimeters, or more preferably at least about 3 or more centimeters. The color and the shape of the device can be selected to make it conspicuous. Orange, white, black, yellow, green, purple are some options for color. The color can also be matched to the particular piece of clothing. A white dress for example can be matched with a dark device. The device can have an LED or other light with a constant or beeping mode. The device can even be made to be fluorescent. The device can be made in a variety of shapes such as a circular or oval shape. Square, rectangular and other shapes can also be made if sharp corners are not an issue.

The ultimate size of the device depends on the nature of the device. A device with a flashing bright LED can for example be conspicuous even if it is very small.

The device can also be placed in a location where it is most conspicuous. An example would be the lower seam of a short dress. The device can also be shaped differently depending on the article of clothing.

The device can have a timer where is can be removed by the consumer but has to be put back within a certain amount of time, such as 0.5 or 1 hour.

The device is removed by the consumer before wearing the dress to a certain occasion. Generally, the device does not interfere with wearing the article of clothing in private to determine whether or not to keep the item of clothing. The device interferes with wearing the article of clothing to events such as parties, wedding, and proms because its conspicuous nature would bring embarrassment to the person wearing the clothing with the device.

The consumer can remove the device at will without a special tool. By a special tool it is meant a tool that is not ordinarily available to a consumer, such as those used with current anti-theft devices. It is not meant to cover a tool readily available to the consumer, such as a tool given to the consumer by the retailer with a purchase. After the device is removed, the consumer can no longer return the dress. The device is designed is such way that it cannot be put back in its original condition after being removed.

A well designed device would avoid accidental removal of the device. For example, the device may be removed by twisting the device while simultaneously holding a button. Or in another embodiment, two buttons have to be pressed simultaneously. In another embodiment, the only way to remove the device is to cut the device, such as with a scissor.

The device can have a unique identification code (serial number), or even a barcode that is scanned, so that a consumer cannot attach a similar device after wearing the article of clothing. The barcode can be laminated. The consumer can be encouraged to return the device by giving a deposit back for the device. The consumer can even be given a pre-paid envelope to return the device.

A standard anti-theft device can be incorporated into the device so that a retailer would only have to use one device. In this embodiment, the anti-theft component is deactivated before the consumer leaves a store, but the consumer still has to disassemble the conspicuous device at a later point.

The article of clothing can be dresses, particularly expensive women's dresses from $100 and more, preferably from $500 to $3000 in 2010 buying power. It can also be men's suits. Other items of clothing include shoes, pants, shirts, handbags, jackets, coats, etc. It can also include jewelry such as rings.

One particular design involves a barbed pin with a rectangular profile that is inserted into a plastic molded shell containing various electronic components (FIGS. 1-7). This pin (I) completes a circuit (G) that performs electrical functions necessary to deter the garment from being worn in public. Any attempt to remove the pin will break a latch and disable the circuitry mentioned above. Breaking the latch (A) will also disable the device mechanically and make it unsuitable to return to a retailer. If garment is to be kept, pin is twisted and it will break off at a weak point built into its base. This will be preferred to avoid pulling the barbed pin back through the garment and hence damaging it. A serial number can be put at the base on the ring or on the receiver.

FIGS. 1-5 describe the barbed pin and the latch that it mates into. The latch (A) is bent up at points A. Barbed pins B will enter the latch, but will not be able to be pulled back without breaking the latch. The latch can be made of a compressed metal that conducts electricity, like aluminum that is part of an electrical switch. There are preferably multiple barbs to allow a secure latch for different thicknesses of garment materials. The pin can have built in weak area at its base (C). This in conjunction with its square design will allow it to be twisted off and broken at base. This action is preferred if customer decides to keep the merchandize. This would also prevent the barbed pin to travel backwards and damage the merchandize.

Figure 6:
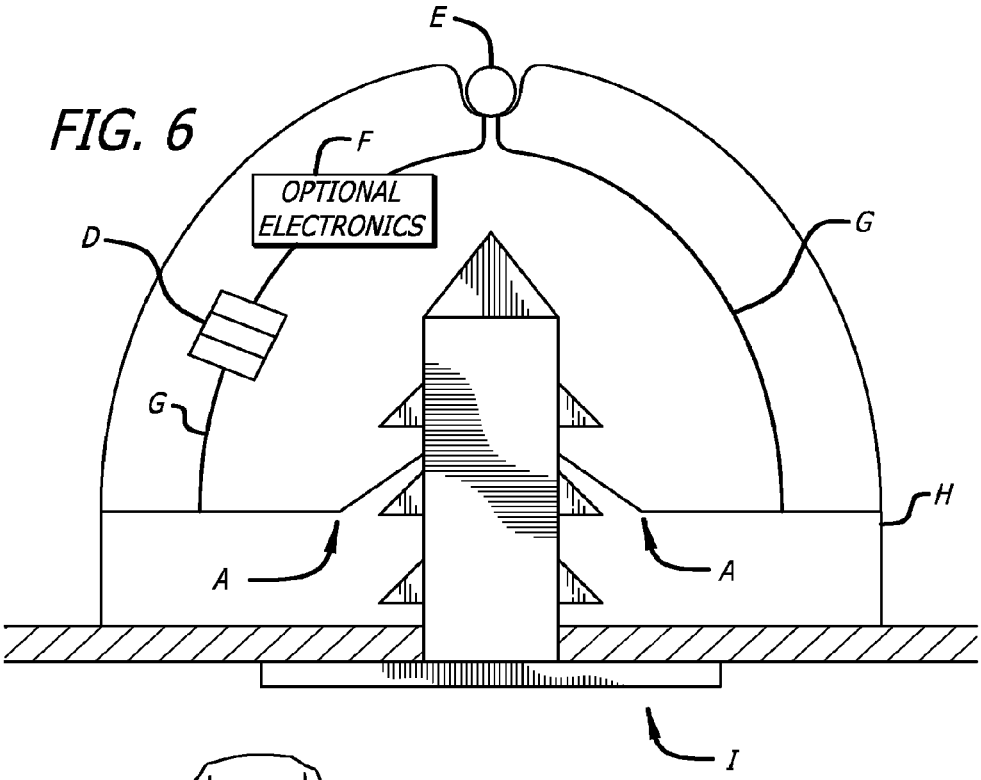
FIG. 6 shows a barbed pin that is inserted in the receiver to form an electrical circuit that is connected to an LED.

FIG. 6 shows a complete device with the pin inserted. The pin (I) and the latch (A) complete an electrical circuit. This electrical circuit is powered by common inexpensive batteries (D) such as those used in watches. Since the circuit is not complete until the pin is inserted, there is no battery drain until the unit is put into use at the point of sale.

At its simplest and most economical form, the circuit turns on an LED (E) that remains on until device is returned to the retailer or removed and discarded. The idea is that the glowing light will deter a person from using that article of clothing.

Adding optional electronics will allow one to do the following: 1) Strobe the light to increase its effectiveness by making it more noticeable. 2) Strobe the light once every 10 seconds to preserve the battery life and still keep the product effective. 3) Add a timer that will keep the LED lit for a set period of time before turning it off. This third item could be used in conjunction with a stores return policy. For example, a piece of merchandize can only be returned when its LED is attached and on. An off LED would indicate that the merchandize has been out longer that policy allows. All electronics can be encapsulated in plastic resin making them tamper proof.

Figure 7:
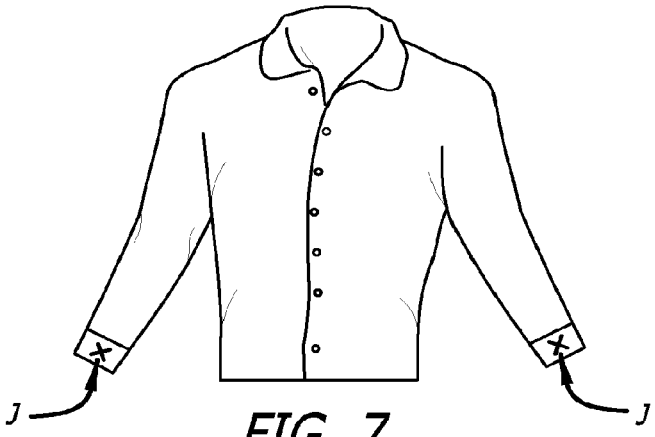
FIG. 7 shows a shirt for attachment of a device to two of its sleeves.
Figure 8:
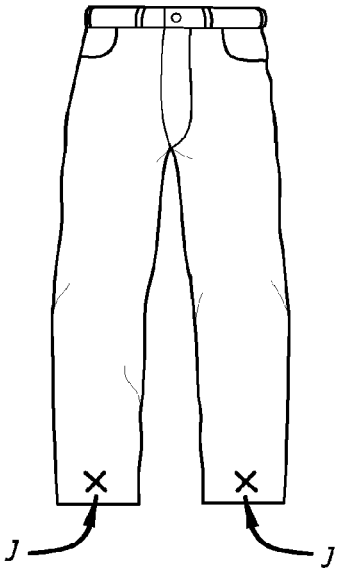
FIG. 8 shows a pair of pants for attachment of a device to the pants.
Figure 9:
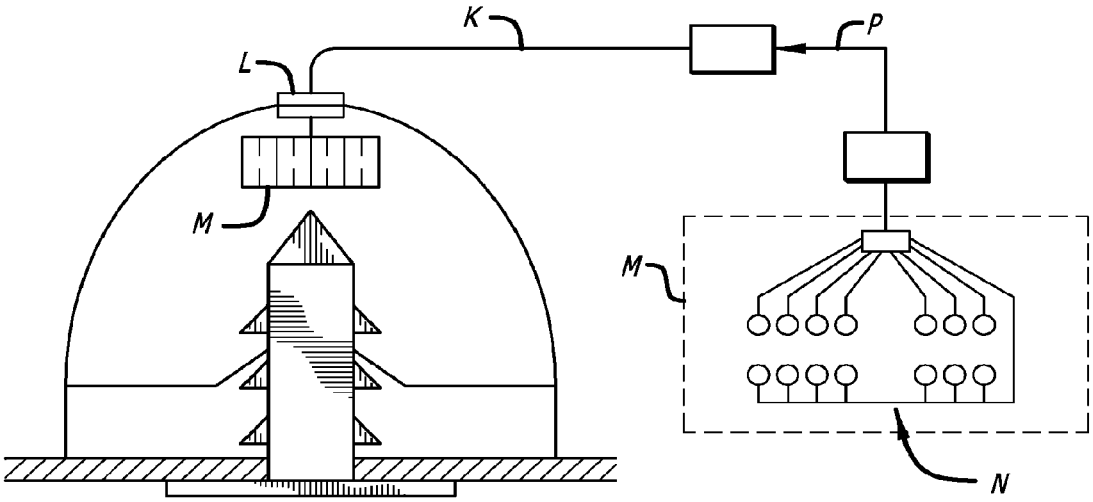
FIG. 9 shows a two part device.
Figure 10:
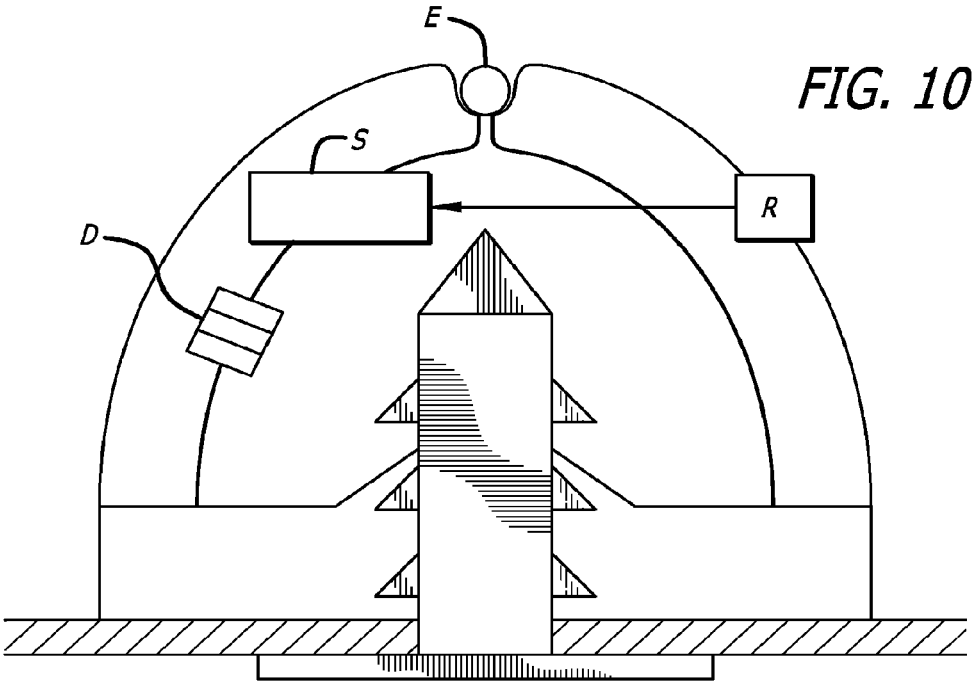
FIG. 10 is a closer look at one of the parts of the two part device.

Another design (FIGS. 7-10) is made of two parts (FIGS. 9 and 10) to be attached to shirt or coat sleeves or pant legs and attached via a cable. It can also be attached to multiple parts of a dress. Both parts are attached to garments by a design similar to the first design. An electrical circuitry will allow the cable to be disconnected for a set amount of time, 0.5 hour for example, before it goes into alarm mode. This alarm mode can be detected by the retailer by monitoring a light emitting diode (LED) (E) or other methods. As an added protection, both parts of this device can be set to send and receive a unique code. This would prevent a consumer from attaching a previously discarded unit to one of these and hiding the connecting cable inside the clothing. FIGS. 7 and 8 signify attachment points for this design. This design makes the product unusable by attaching sleeves or pant legs together. It can also attach two parts of a dress together. Even though this design shows parts to be connected via a cable (K), this cable can be very short or nonexistent if two parts of this device where to be directly attached to each other.

Part one of this design (O) uses a pin and latch as described in the first design. These serve to secure the part. A multi strand wire exits this part and connects to part 2 (Q) via connecter P attaching to R. Part 1 contains embedded links M that are made of programmable links N. Wire k can have different number of strands. In this example, it has 8 strands. Links N can be open or shorted together. In this example, there will be 128 different possibilities. These links are set in a specific configuration when they are manufactured. This configuration (code) is expected from electronics built into matching part 2 of this design.

Part 2 of this design is activated at the point of sale. Electronic circuit (S) will receive a matching code from part one via connector R. This would be the case when part 1 and part 2 remain attached. The customer will be allowed to disconnect these two parts for a set amount of time, say 30 minutes, to try the product. After allowed time has expired, an LED would go on or flash. This would inform the retailer in case of return that the product may have been worn and used if it were to be returned.

Purely mechanical designs are illustrated in FIGS. 11-19. One of ordinary skill of art can appreciate that these designs can be modified by adding electrical components to them.

Figure 11:
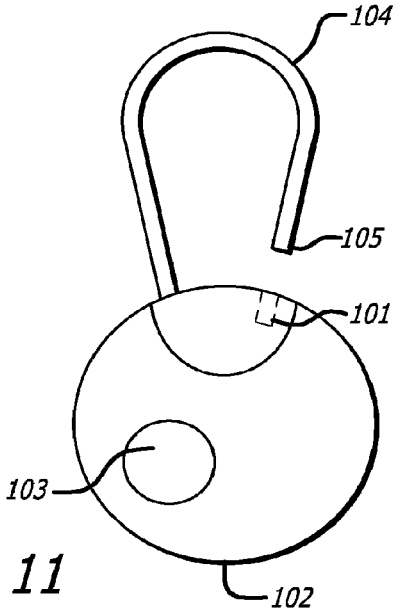
FIG. 11 shows a ball and strap design.
Figure 12:
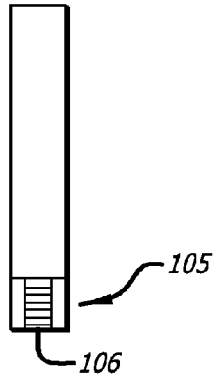
FIG. 12 is a closer look of the strap of the ball.
Figure 13:
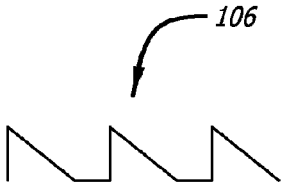
FIG. 13 shows the ridge depth profile at end of strap.
Figure 14:
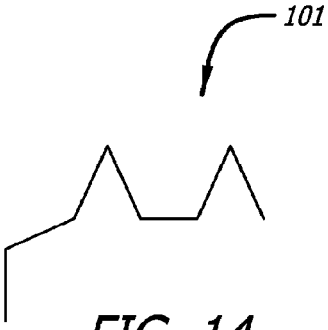
FIG. 14 is the side view of the latch.
Figure 15:
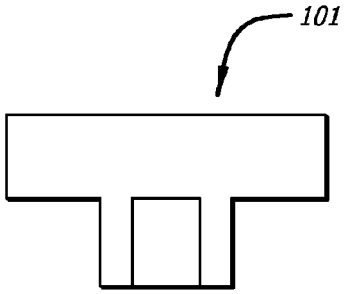
FIG. 15 is a top view of the receiver.

FIG. 11 shows a ball (102) that has a receiver (101). The ball can be made of entirely plastic or a combination of plastic and foam. Logo (103) can be placed on the ball. Strap 104 is attached to the ball and is inserted into the receiver (101) by a salesperson. The strap 104 has a mating end 105 with one or more ridges (106). FIGS. 14 and 15 show the latch present in the receiver where the ridges of the mating end "click" into and the strap can no longer be taken out the receiver, leaving the consumer with the choice of cutting the strap to remove the device. If an anti-theft device is included, it would cover and prevent the pin from being broken while in the store.

FIG. 11 shows a conspicuous receiver in the shape of a ball attached to a cord. The other end of the cord, free end (mating end) is then inserted through. Receiver ridges at the end of the cord mate with a latch. The latches are built in the receiver. The latch allows for entry of the mating end but not its exit. The receiver can be made of plastic or combination with foam. Light weight materials are preferred.

FIG. 16 shows a pin (111) with a weak point (110) in a receiver (107). The pin's head (109) compresses through the channel of the receiver but cannot come out. The garment (108) is held between the pin (110) and the receiver (107). The head of the pin (109) is designed with a shape that it can be compressed as it enters the receiver, but once in place, it cannot be removed by the consumer.

FIGS. 17-19 show a mechanical design where a pin is not used. The advantage of this design is that there would be no possible damage from inserting a pin. Design in FIG. 17 shows a receiver (113) in the shape of a ball (preferably with a diameter of about 2 to about 5 inches) with a strap (114) attached to it at one end. A weak point (115) can be built into the design so if a consumer were to tamper with the device by pulling the receiver the receiver would snap. Preferably the strap and the ball are of the same piece of plastic. The design can incorporate a unique serial number or barcode so that a consumer cannot replace the device by obtaining another one. The head of the strap (109) is compressed through a hole or channel and cannot get out after it is in place. FIG. 18 shows the basic design as FIG. 17 except that the strap is inserted to a receiver that the strap is not attached to. FIG. 19 is the same design as that of FIG. 18 but one of the bulky balls is replaced with a smaller piece so it can be worn inside of a dress. These designs that do not use a pin are designed to loop around a part of the piece of clothing such as a strap (FIG. 20), front of opened end shoe (FIG. 21), the tag (FIG. 23), or the sleeve (FIG. 22). These devices can also be used to loop around rings and straps of handbags. The size of the device is such tag it cannot go through the tag. The size also is sufficiently large so that a consumer cannot wear the device inside. A ball with a diameter of about 2 to about 6 inches is preferred.

What is claimed is:

1. A device having mechanical components without an electrical component for deterring purchase-use-return of an article of clothing by a customer comprising:

a) a member having a pin attached thereto, the pin for going through a material of the article of clothing;

b) a receiver for receiving the pin after the pin passes through the material of the article of clothing, the pin not capable of being removed from the receiver without breaking the device;

c) a weak-point for attaching the member that allows the customer to remove the device after purchasing the article of clothing by breaking the device, the device not capable of being put back on the article of clothing in original condition after the device is broken by the customer;

wherein the device has only mechanical components;

wherein the device is configured to stop purchase-use-return of the article of clothing by the customer;

wherein absence of the device on the article of clothing is an indication that the customer has used the article of clothing and has removed the device;

wherein the customer is able to wear the article of clothing with the device attached thereto to determine whether or not to keep the article of clothing; and wherein the device after attachment to the article of clothing is configured for taking outside of a store with the article of clothing attached thereto.

2. The device of claim 1, wherein the device is configured to be attached to a lower portion of the article of clothing.

3. The device of claim 1, wherein the device is configured to break in an event the customer attempts to remove the pin from the article of clothing without breaking the device.

4. The device of claim 1, wherein the pin is attached to the member in a perpendicular direction, the article of clothing is a dress, and the device is configured to break in an event the customer attempts to remove the pin from the article of clothing without breaking the device first.

5. The device of claim 1, wherein the device is configured to be attached to a seam of the article of clothing.

6. The device of claim 1, wherein the device is configured to be attached to a lower seam of the article of clothing.

7. The device of claim 1, herein the device is configured to be broken by cutting the device with scissors.

8. The device of claim 1, wherein the article of clothing is a dress.

9. The device of claim 1, wherein the pin is attached to the member in a perpendicular direction.

10. The device of claim 1, wherein the device is configured to break in an event the customer attempts to remove the pin from the article of clothing without breaking the device, wherein the article of clothing is a dress, and wherein the pin is attached to the member in a perpendicular direction.

11. The device of claim 10, wherein the device is configured to be attached to a lower part of the dress.

12. A device having mechanical components without an electrical component for deterring purchase-use-return of an article of clothing by a customer comprising:

a) a member having a pin attached, the pin for going through a material of the article of clothing;

b) a receiver for receiving the pin after the pin passes through the material of the article of clothing, the pin not capable of being removed from the receiver without breaking the device;

c) a weak point for attaching the member that allows the customer to remove the device after purchasing the article of clothing by cutting the device with scissors, the device not capable of being put back on the article of clothing in original condition after the device is cut by the customer;

wherein the device has only mechanical components;

wherein the device is configured to stop purchase-use-return of the article of clothing by the customer;

wherein absence of the device on the article of clothing is an indication that the customer has used the article of clothing and has removed the device;

wherein the customer is able to wear the article of clothing with the device attached thereto to determine whether or not to keep the article of clothing; and wherein the device after attachment to the article of clothing is configured for taking outside of a store with the article of clothing attached thereto.

13. The device of claim 12, wherein the device is configured to break in an event the customer attempts to remove the pin from the article of clothing without breaking the device.

14. The device of claim 12, wherein the device can only be removed by cutting the device.

15. The device of claim 12, wherein the device is configured to be attached to a lower portion of the article of clothing.

16. The device of claim 12, wherein the device is configured to be attached to a seam of the article of clothing.

17. The device of claim 12, wherein the device is configured to be attached to a lower seam of the article of clothing.

18. The device of claim 12, wherein the pin is attached to the member in a perpendicular direction.

19. The device of claim 12, wherein the article of clothing is a dress.

20. The device of claim 12, wherein the device is configured to break in an event the customer attempts to remove the pin from the article of clothing without breaking the device, wherein the article of clothing is a dress, and wherein the pin is attached to the member in a perpendicular direction.

21. A device having mechanical components without an electrical component for deterring purchase-use-return of a dress by a customer comprising:

a) a member having a pin attached thereto, the pin for going through a material of the dress, the pin attached to the member in a perpendicular direction;

b) a receiver for receiving the pin after the pin passes through the material of the dress, the pin not capable of being removed from the receiver without breaking the device;

c) a weak-point for attaching the member that allows the customer to remove the device after purchasing the dress by breaking the device, the device not capable of being put back on the dress in original condition after the device is broken by the customer;

wherein the device has only mechanical components;

wherein the device is configured to stop purchase-use-return of the dress by the customer;

wherein absence of the device on the dress is an indication that the customer has used the dress and has removed the device;

wherein the customer is able to wear the dress with the device attached thereto to determine whether or not to keep the dress;

wherein the device after attachment to the dress is configured for taking outside of a store with the dress attached thereto; and wherein the device is configured to break in an event the customer attempts to remove the pin from the dress without breaking the device.

* * * * *